United States Patent [19]

Andersson et al.

[11] Patent Number: 4,961,825

[45] Date of Patent: Oct. 9, 1990

[54] PAPERMAKING PROCESS

[75] Inventors: Kjell R. Andersson, Kirland, Canada; Bernt Larsson, Backa, Sweden; Hans-Olof Thoresson; Bo V. Larsson, both of Partille, Sweden

[73] Assignee: Eka Nobel AB, Surte, Sweden

[21] Appl. No.: 411,241

[22] Filed: Sep. 22, 1989

Related U.S. Application Data

[63] Continuation of Ser. No. 128,457, Dec. 3, 1987, abandoned, which is a continuation of Ser. No. 841,524, filed as PCT SE85/00239 on Jun. 6, 1985, published as WO86/00100 on Jan. 3, 1986, abandoned.

[30] Foreign Application Priority Data

Jun. 7, 1984 [SE] Sweden ..... 8403062

[51] Int. Cl.[5] ..... D21H 17/24; D21H 17/74

[52] U.S. Cl. ..... 162/175; 162/178; 162/181.6; 162/183

[58] Field of Search ..... 162/181.6, 181.3, 181.5, 162/181.1, 175, 178, 183; 106/214, 164, 286.5

[56] References Cited

U.S. PATENT DOCUMENTS

| | | | |
|---|---|---|---|
| 3,520,824 | 7/1970 | Plank et al. | 252/313 |
| 4,385,961 | 5/1983 | Svending et al. | 162/181.6 |
| 4,388,150 | 6/1983 | Sunden et al. | 162/175 |

*Primary Examiner*—Peter Chin

*Attorney, Agent, or Firm*—Burns, Doane, Swecker & Mathis

[57] ABSTRACT

In the production of paper or pulp sheets from a paper stock, a binder is added which comprises cationic and anionic components to improve the paper characteristics and the stock characteristics, such that increased retention and a more readily dewatered stock are obtained.

The anionic component consists of colloidal anionic particles having at least one surface layer of aluminum silicate or aluminum-modified silicic acid, such that the surface groups of the particles contain silicium and aluminum atoms in a ratio of from 9.5:0.5 to 7.5:2.5.

The cationic component consists of cationic carbohydrate having a degree of substitution of 0.01–1.0.

13 Claims, 5 Drawing Sheets

PAPERMAKING PROCESS

This application is a continuation of application Ser. No. 128,457, filed Dec. 3, 1987 abandoned, which is a continuation application of Ser. No. 841,524 filed as PCT SE85/00239 on Jun. 6, 1985, published as WO86/00100 on Jan. 3, 1986, abandoned.

FIELD OF THE INVENTION

The present invention relates in general to a papermaking process and, more particularly, to a binder which is used in a papermaking process and which produces a paper having improved strength and other characteristics. Such a binder also gives highly improved retention levels and a more readily dewatered pulp. In the context of the present invention, the term "papermaking" also comprises the production of pulp sheets, with the accent on dewatering and retention.

At the present time, the papermaking industry is plagued with a number of serious problems. First, the price of cellulosic pulp has escalated materially and high quality pulp is in relatively short supply. Second, various problems, including the problems inherent in the disposal of papermaking wastes and the ecological requirements of various governmental bodies, have markedly increased the cosst of papermaking. Finally, the cost of the energy required to make paper has increased materially. As a result, the industry and its customers are faced with two choices: either pay the higher costs or materially decrease the amounts and/or quality of the cellulosic fibers with a consequential loss of quality in the finished paper product.

The industry has made various attempts to reduce the cost of the paper products. One approach that has been employed involves the addition of clay and other mineral fillers to replace fiber, but such additions have been found to reduce the strengh and other characteristics of the resulting paper to a degree which is unsatisfactory. Also, the addition of such mineral fillers results in poor retention of the filler, i.e. the filler passes through the wire to an extent such that the filler contents build up in the white water, with the result that the clean-up of white water and the disposal of the mineral has become a serious problem. Various retention aids have been employed in an attempt at alleviating the retention problem, but most retention aids have proved to have an effect which is not entirely satisfactory.

Attempts have also been made at using pulp types which are less expensive and of lower quality, but this, of course, results in a reduction in the characteristics of the paper and often results in excessive fines which are not retained in the paper and, consequently, cause white water disposal problems.

SUMMARY OF THE INVENTION

Accordingly, the principal object of the present invention is the provision of a binder system and a method which produce improved properties in the paper and which will permit the use of minimum amounts of fiber material to give the requisite strength and other characteristics. Another object of the invention is the provision of a binder system and a method of employing it which materially improve the strenght and other characteristics of the paper as compared to a similar paper made with known binders. An additional object of the invention is the provision of a binder and a method of employing it which maximise the retention of mineral filler and other materials in the paper sheet produced, when the binder is used in the stock on the papermaking machine. A further object of the invention is the provision of a paper having a high content of mineral filler as well as acceptable strength and other characteristics. Still another object of the invention is to improve in particular the dewatering but also the retention characteristics of the papermaking pulp in the production of pulp sheets on wet machines, thereby to reduce the need for drying and to obtain higher fibre yields.

Other objects and advantages of the invention will appear from the following description and the appended drawings in which:

DESCRIPTION OF THE PREFERRED EMBODIMENTS

Figure 1:
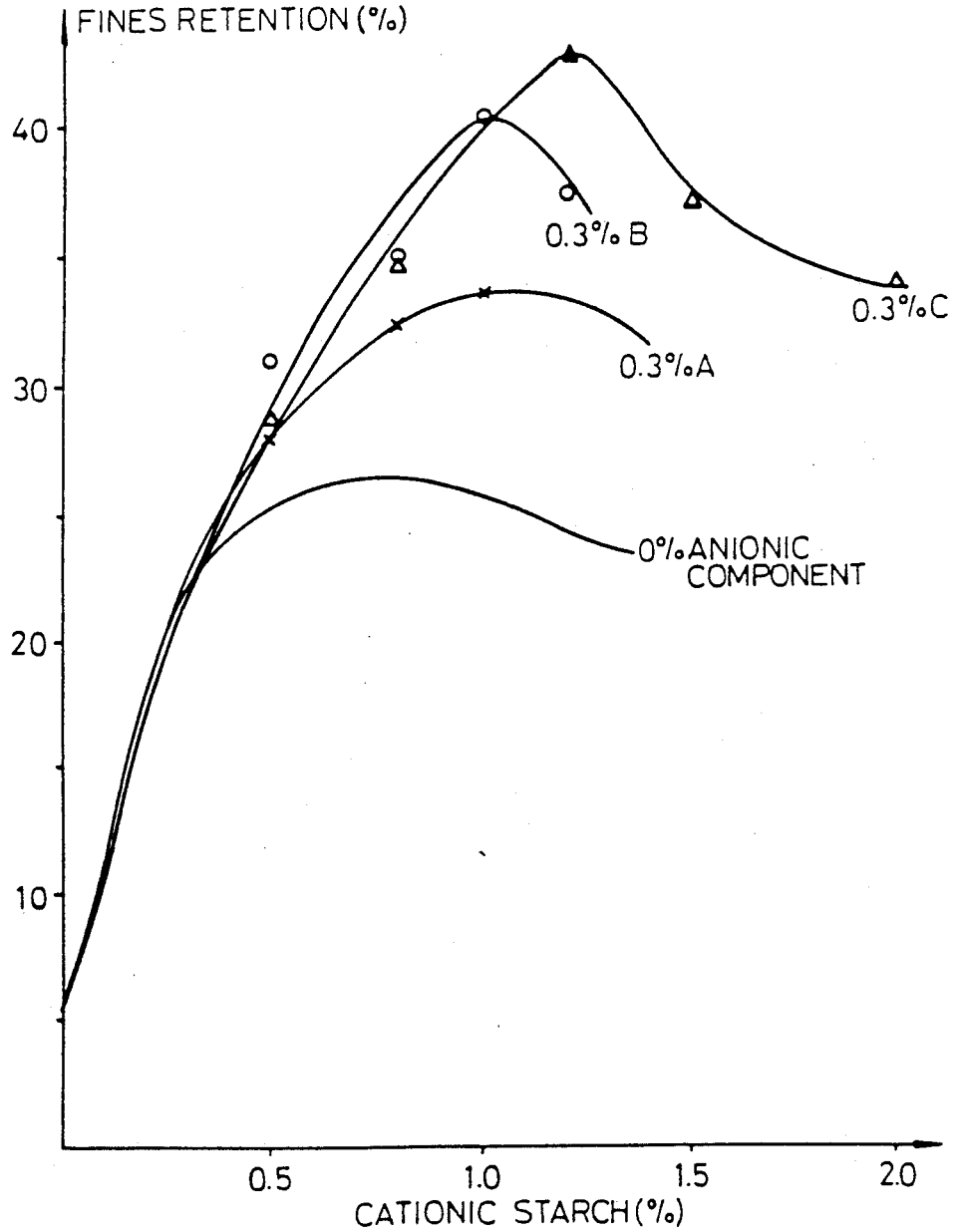
FIGS. 1–5 are diagrams showing the results of tests carried out with paper sheets produced in accordance with the following Examples and illustrate different aspects of the invention.

The invention is based on the discovery of a binder and a method of employing it, which materially increase the strength and improve other characteristics of a paper product and which, furthermore, permit the use of substantial amounts of mineral filler in the papermaking process, while maximising the retention of the filler and the cellulosic fibers in the sheet. The invention makes it possible, for a given grade of paper, to reduce the cellulosic fiber content of the sheet and/or the quality of the cellulosic fiber, without undue reduction of the strength or other characteristics of the paper. Also, by employing the principles of the invention, the amount of mineral filler may be increased without unduly reducing the strength and other characteristics of the resulting paper product. Furthermore, the present invention provides for a high retention of mineral filler and other fine-grained material. In addition, a pulp is obtained which is readily dewatered. The last-mentioned characteristic makes it possible to reduce the cost of the energy required for drying the paper or to increase production in those cases when the drying capacity of the papermaking or wet machine restricts the production rate. These advantages of the present invention are illustrated in the following Examples.

In general, the system of the invention includes the use of a special binder complex which comprises two components, one anionic and one cationic component. The anionic component is formed of anionic colloidal particles having at least one surface layer of aluminium silicate or aliuminum-modified silicic acid, such that the surface groups of the particles will contain silicium and aluminium atoms in a ratio of from 9.5:0.5 to 7.5:2.5. The cationic component is formed of cationic or amphoteric carbohydrate, preferably starch, amylopectin and/or guar gum, the carbohydrate being cationised to a degree of substitution of at least 0.01 and at most 1.0.

The invention is based on the discovery that it is possible, within the entire conventional pH range of from about 4 to about 10 for papermaking stock, especially within the lower half of this pH range, to obtain considerable advantages, int.al. in respect of dewatering and retention, if use is made of such an anionic component having a particle surface of aluminium silicate or aluminium-modified silicic acid. As will appear from the following Examples, such as anionic component will enhance, within the binder complex, the advantageous effect of the cationic component added, which, inter alia, will improve these two factors within the entire pH range, an improvement which is especially pronounced within the lower half of the pH range.

If a pure aluminium silicate sol is used as colloidal particles, this sol can be produced in known manner by precipitation of water glass with sodium aluminate. Such a sol has homogeneous particles so that the particle surface has silicium and aluminium atoms in the ratio 7.5:2.5. Alternatively, use may be made of an aluminium-modified silicic acid sol, i.e. a sol in which but a surface layer of the sol particle surface contains both silicium atoms and aluminium atoms. Such an aluminium-modified sol is produced by modifying the silicium surface of a silicic acid sol with aluminate ions, which is possible presumably because aluminum and silicium are capable, under appropriate conditions, to assume the coordination number 4 or 6 in relation to oxygen, and because they both have approximately the same atomic diameter. Since the aluminate ion $Al(OH)_4^{-1}$ is geometrically indentical with $Si(OH)_4$, the ion can be inserted or substituted into the $SiO_2$ surface, thus generaing an aluminium silicate seat having a fixed negative charge. Such an aluminium-modified silicic acid sol is far more stable against gel formation within the pH range 4–6 within which unmodified silicic acid sols may gel rather quickly, and is less sensitive to salt. The production of aluminium-modified silicic acid sols is will known and disclosed in literature for example in the book "The Chemistry of Silica" by Ralph K. Iler, John Wiley & Sons, New York, 1979, pp. 407–410.

The modification of the silicic acid sol thus implies that a given amount of sodium aluminate is caused to react at high pH (about 10) with the colloidal silicic acid, and this means that the colloidal particles will obtain surface groups that consist of $Al\text{-}OH^{-1}$. At low pH (4–6) these groups are strongly anionic in character. This strong anionic character at low pH is not obtained with a pure unmodified silicic acid sol because silicic acid is a weak acid with $pK_s$ at about 7.

Actually, there have already been used, in the production of sheet products, binders that are based on a combination of cationic substances and anionic substances. Thus, U.S. Pat. No. 3,253,978 discloses the production of an inorganic sheet, use being made of a combination of cationic starch and silicic acid, although flocculation is here counteracted, and very high silicic acid contents are used. This patent teaches away from the present invention in that it stipulates that the cationic component must not be allowed to gel the anionic component, even though the latter has a tendency towards flocculation. Gelling and flocculation are held to reduce dewatering and to cause adhesion to the wire and also to reduce the porosity of the finished sheet, for which reason flocculation and gelling are counteracted by pH control.

Also in the papermaking process disclosed in the European Patent EP-B-0041056 use is made of a binder comprising colloidal silicic acid and cationic starch. This papermaking process has proved to give excellent results with most papermaking stocks, but may in some instances fail to give the desired improvement of the dewatering and retention characteristics. It may also happen that this technique requires the addition of considerable quantities of cationic starch in order to achieve the desired dewatering and retention characteristics. High starch contents in the paper may increase the paper hardness, and this may occasionally be unsuitable.

To counteract the unfavourable effect of the cationic starch at high addition levels, EP-A-0080986 suggests that the binder complex consist of colloidal silicic acid and amphoteric or cationic guar gum.

The two last-mentioned processes implied a marked improvement in relation to prior art technique. Nevertheless, it has now surprisingly been found that the invention makes it possible to enhance the effect of the binder complex it the anionic component is formed of the above-mentioned anionic colloidal particles which consist of aluminium silicate or have a surface layer of aluminium silicate, or consist of an aluminium-modified silicic acid sol. The enhanced effect of the binder complex may be used either in order to reduce the amount in which the complex must be added, while retaining the effect obtainable with one and the same cationic component and a silicic acid sol, or to gain further advantages in respect of, for example, dewatering and retention, which is of importance for all paper products but is especially important in producing pulp sheets on wet machines in pulp mills.

Based upon the experiments and the work that have been done to date, the principles of the invention are believed to be applicable in the manufacture of all grades and types of paper, for example printing grades, including newsprint, tissue, paper board, liner and sack paper, pulp sheets, and the like.

It has been found that the greatest improvements are observed when the binder is employed with chemical pulps, such as sulfate and sulfite pulps from both hardwood and softwood. Lesser but highly significant improvements occur with thermomechanical and mechanical pulps. It has been noted that the presence of excessive amounts of lignin in the groundwood pulps seems to interfere with the efficiency of the binder so that such pulps may require either a greater proportion of binder or the admixture of a greater proportion of other pulp types of low lignin content to achieve the desired result. (As used herein, the terms "cellulosic pulp" and "cellulosic fibers" refers to chemical, thermomechanical and mechanical or groundwood pulp and the fibers contained therein.)

The presence of cellulosic fibers is essential to obtain, in the present invention, the improved results which occur because of the interaction or association of the agglomerate and the cellulosic fibers. Preferably, the finished paper or sheet should contain over 50% cellulosic fibers, but paper containing lesser amounts of cellulosic fibers may be produced which have greatly improved properties as compared to paper made from similar stocks not employing the binder agglomerate according to the invention.

The mineral fillers which may be employed include any of the common mineral fillers having a surface which is at least partially anionic in character. Mineral fillers such as kaolin, bentonite, titanium dioxide, gypsum, chalk and talc all may be employed satisfactorily. (The term "mineral filler" as used herein includes, in addition to the foregoing materials, wollastonite and glass fibers and also mineral low-density fillers, such as expanded perlite.) When the binder complex disclosed herein is employed, the mineral fillers will be substantially retained in the paper product, and the paper will not have its strength deteriorated to the degree observed when the binder is not employed.

The mineral filler is normally added in the form of an aqueous slurry in the usual concentrations employed for such fillers.

As mentioned above, the mineral fillers in the paper may consist of or comprise a low-density or high-bulk filler. The possibility of adding such fillers to conventional paper stocks is limited by factors such as the retentions of the fillers on the wire, the dewatering of the paper stock on the wire, and the wet and dry strength of the paper produced. It has been discovered that the problems caused by the addition of such fillers can be obviated or substantially eliminated by using the binder complex of the present invention which also makes it possible to add higher than normal proportions of such fillers to obtain special properties in the paper product. Thus, by using the binder complex according to the invention, it has become possible to produce a paper product of low density and consequently higher stiffness at the same grammage and simultaneously to maintain the strength properties of the paper product (such as the modulus of elasticity, the tensile index, the tensile energy absorption and the surface picking resistance) at the same level as or even at a better level than before.

As has been pointed out above, the binder comprises a combination of a cationic component and, as the anionic component, an anionic collodial aluminum silicate sol or an anioinic colloidal aluminium-modified silicic acid sol. The, so far, best results of the invention have been observed when the anionic colloidal particles in the sol have a surface area of 50–1000 $m^2/g$ and preferably about 200–1000 $m^2/g$, the best results having been observed when the surface area was about 300–700 $m^2/g$.

When a colloidal aluminium-modified silicic acid is used in the form of a sol, it has been found extremely advantageous to use a sol which, prior to the aluminium-modification, contains about 2–60% by weight $SiO_2$, preferably about 4–30% by weight $SiO_2$, and which has been modified such that the surface of the sol particles have obtained surface groups in the above-mentioned ratio of silicium to aluminium atoms. Such a sol may be stabilised with an alkali having a molar ratio of $SiO_2$ to $M_2O$ of from 10:1 to 300:1, preferably 15:1 to 100:1 (M is an ion selected from the group consisting of Na, K, Li and $NH_4$). It has been established that the size of the colloidal particles should be under 20 nm and preferably should have an average particle size ranging from about 10 down to 1 nm (a collodial Al-modified silicic acid particle having a surface area of about 550 $m^2/g$ corresponds to an average particle size of about 5.5 nm).

Preferably, it is sought to employ an Al-modified silicic acid sol with anionic colloidal silicic acid particles having a maximum active surface and a well defined small size generally averaging 4–9 nm.

Silicic acid sols meeting the above specifications are commercially available from various sources, including Nalco Chemical Company, DuPont & de Nemours Corporation, and EKA AB.

According to the invention, the cationic or amphoteric component in the binder system should be a cationic or amphoteric carbohydrate cationised to a degree of substitution of at least 0.01 and at most 1.0. The best results so far have been obtained when the carbohydrate component consisted of starch, amylopectin and/or guar gum which therefore are the preferred carbohydrates.

The guar gum which may be employed in the binder according to the present invention, is an amphoteric or cationic guar gum. Guar gum occurs naturally in the seeds of the guar plant, for example, Cyamopsis tetragonalobus. The guar molecule is a substantially straight-chained mannan which is branched at quite regular intervals with single galactose units on alternating mannose units. The mannose units are linked to one another by means of $\beta$-(1–4)-glycosidic linkage. The galactose branching is obtained through an $\alpha$-(1–6) lingkage. The cationic derivatives are formed by reaction between the hydroxyl groups of polygalactomannan and reactive quaternary ammonium compounds. When using guar gum, the degree of substitution of the cationic groups is suitably at least 0.01 and preferably at least 0.05 and may be as high as 1.0. A suitable range may be from 0.08 to 0.5. The molecular weight of the guar gum is assumed to range from 100,000 to 1,000,000, generally about 220,000. Suitable cationic guar gums are mentioned in EP-A-0018717 and EP-A-0002085 in conjunction with shampoo preparations and rinsing agents for textiles, respectively. Natural guar gum provides, when used for a paper chemical, improved strength, reduced dust formation and improved paper formation. The disadvantage of natural guar gum is that it renders the dewatering process more difficult and thereby reduces production output or increases the need of drying. Admittedly, these problems have been overcome to a great extent by the introduction of the use of chemically modified guar gums which are amphoteric or cationic. However, the cationic or amphoteric guar gums which are available on the market have not previously been used in binder complexes of the type utilised in the present invention. There are commercially available guar gums wiht different cationisation degrees and also amphoteric guar gums.

Amphoteric and cationic guar gums which may be used in connection with the present invention, are commercially available from various sources, including Henkel Corporation (Minneeapolois, Minn., U.S.A.) and Celanese Plastics & Specialities Company (Louisville, Ky., U.S.A.) under the trade marks GENDRIV and CELBOND.

If cationic starch is used as the cationic component for the purpose of the present invention, the cationic starch may have been produced from starches derived from any of the common starch-producing materials, such as corn starch, wheat starch, potato starch, rice starch etc. As is well known, a starch is made cationic by ammonium group substitution according to known technique, and may have varying degrees of substitution. For the purpose of the present invention, it is preferred to use degrees of substitution of between 0.01 and 0.1 for the cationic starch. The best results have been obtained when the degree of substitution (d.s.) is between 0.01 and about 0.05 and preferably between about 0.02 and about 0.04, and most preferably above about 0.025 and under about 0.04. Even though a wide variety of ammonium compounds, preferably quaternary ones, are employed in making cationised starches for use in the binder of the present invention, it is preferred to employ a cationised starch which has been prepared by treating the base starch with 3-chloro-2-hydroxypropyltrimethyl ammonium chloride or 2,3-ethoxypropyltrimethyl ammonium chloride to form a cationised starch having a degree of substitution of 0.02–0.04.

When amylopectin is used as cationic carbohydrate, the degree of substitution preferably is 0.01–0.01. In this instance, the same narrower and more preferred ranges as for cationic starch also apply.

In the papermaking or pulp sheet making process, the binder is added to the stock prior to the time when the paper or sheet product is formed on the papermaking and the wet machine, respectively. The other in which the two components are added, and where they are added, will depend upon the type of papermaking machine employed and also upon the mechanical stress to which the stock is subjected before it is discharged on the wire. It is important, however, that the two components be distributed such in the stock that they are jointly present therein when discharged on the wire, and such that they have before then had time to interact with one another and with the stock components.

It has been found that the pH of the stock, in a papermaking process utilising the binder complex according to the invention, is not unduly critical and may range from 4 to 10. However, pH ranges higher than 10 and lower than 4 are unsuitable. Compared to unmodified silicic acid as anionic component, however, far better results are obtained, especially at low pH within this pH range.

Other paper chemicals, such as sizing agents, alum and the like may be employed, but care should be take that the level of these agents is not great enough to interfere with the formation of the agglomerate of anionic Al-modified silicic acid and cationic starch and/or guar gum, and that the levels of the additives in question in the recirculated white water do not become excessive so as to interfere with the formation of the binder agglomerate. Therefore, it is usually preferred to add the chemicals at a point in the system after the agglomerate has been formed.

According to the invention, the weight ratio of the amphoteric or preferably cationic component to the anionic colloidal Al-modified silicic acid component should be between 0.01:1 and 25:1. Preferably, this weight ratio is between 0.25:1 and 12.5:1.

The amount of binder to be employed varies with the desired effect and the characteristics of the particular components which are selected in making up the binder. For example, if the binder includes polymeric Al-modified silicic acid as the component consisting of colloidal Al-modified silicic acid, more binder may be required than if the colloidal Al-modified silicic acid component is colloidal Al-modified silicic acid having a surface area of 300–700 $m^2/g$. Similarly, if a lower degree of substitution is used for the cationic component, a greater amount of binder may be required assuming that the colloidal Al-modified silicic acid component is unchanged.

When the stock does not contain a mineral filler, the level of the binder may generally range from 0.1 to 15% by weight, preferably from 0.25 to 5% by weight, based upon the weight of the cellulosic fiber. As has been pointed out above, the effectiveness of the binder is greater with chemical pulps so that less binder will be required with these pulps to obtain a given effect than with other types of pulps. In the event that a mineral filler is utilised, the amount of binder may be based on the weight of the filler and may range from 0.5 to 25% by weight, usually from 2.5 to 15% by weight, based upon the filler.

The invention will be illustrated in greater detail below by means of a number of Examples. These Examples disclose different beating methods and properties of the finished products. The following standards have been utilised for the various purposes involved:

| | |
|---|---|
| Beating in Valley Hollander | SCAN-C 25:76 |
| Beating degrees: | |
| Canadian Standard Freeness Tester | SCAN-C 21:65 |
| Schopper-Riegler | SCAN-C 19:65 |
| Sheet formation | SCAN-C 26:76 |
| Grammage | SCAN-P 6:75 |
| Density | SCAN-P 7:75 |
| Filler content | SCAN-P 5:63 |
| Tensile index | SCAN-P 38:80 |
| Z-strength | Alwetron |
| Ash content (quick ash) | Greiner & Gassner GmbH, Munich |
| Tensile energy absorption index | SCAN-P 38:80 |

When testing the produced sheets, these were conditioned first at 20° C. in air with a relative humidity of 65%.

The retention measurements related in the Examples were carried out by means of a so-called dynamic dewatering jar ("Britt-jar") which was provided with an evacuation pump and a measuring glass for collecting the first 100 ml of sucked-off water. In the measurements, use was made of a baffled dewatering vessel which had a wire (40M) with a mesh size of 310 μm. The suck-off rate was controlled by means of glass tubes of different diameter and was 100 ml/15 s. in the experiments. The following measurement method was utilised:

1. 500 ml pulp suspension was added under agitation at 1000 rpm and timekeeping was started.
2. After 15 s, colloidal silicic acid and filler were added. The total solids content (fibers+filler) should be 0.5%.
3. After 30 s, the guar gum, amylopectin and/or the cationic starch were added.
4. After 45 s, the sucking-off was started.
5. The first 100 ml of water were collected and filtered through a filter paper which had been weighed and was of grade 00.
6. The filter paper was dried, weighed and burned to ash.
7. The retention was calculated.

This retention measurement method is described by K. Britt and J. E. Unbehend in Research Report 75, 1/10 1981, published by Empire State Paper Research Institute ESPRA, Syracuse, N.Y. 13210, USA.

In the following Examples, commercially available clay and chalk, as well as cationic starch have been utilised. Moreover, commercially available retention agents have been used as references.

The chalk "SJÖHÄSTEN ® NF" used in the Examples is a natural, high-grade calcium carbonate of amorphous structure and is marketed by Malmökrita Swedish Whiting Company Limited, Malmö, Sweden. The C grade clay and Superfill-clay used are kaolin purchased from English China Clay Limited, Great Britain.

The different guar gum types employed were as follows:

GENDRIV ® 158 and 162 are cationic guar gum types, GENDRIV ® 158 having moderate and GENDRIV ® 162 strong cationic activity. Both were purchased from Henkel Corporation, Minneapolis, Minn., USA.

CELBOND ® 120 and CELBOND ® 22 are guar gum types purchased from Celanese Plastics and Specialities Company, Louisville, Ky., USA. CELBOND ® 120 is an amphoteric guar gum with both cationic and anionic properties. CELBOND® 22 is a low-substituted cationic guar gum with added guaternary ammonium groups.

PERCOL® 140 is a cationic polyacrylamide which was used as retention aid and was purchased from Allied Colloids, Great Britain.

The contents indicated in the following Examples are all calculated on a dry weight basis.

EXAMPLE 1

In this Example, a stock was produced which had the composition:

70% of fully bleached chemical pulp (60/40 fully bleached birch sulfate/pine sulfate)

30% C clay (English China Clay).

The chemical pulp had been beaten in a laboratory hollander to 200 ml CSF. The stock was diluted to a dry solids content of 0.5%, and 1% alum was added, whereupon the pH of the stock was adjusted to 4.0–4.5 with sulphuric acid.

The retention and dewatering characteristics of the stock were determined at different chemical dosages. For the retention measurements, use was made of a dynamic dewatering jar, Britt-jar. The agitator speed was 800 rpm and the wire had a mesh number of 200. The fines content of the stock was determined at 3.6% (a fraction passing through 200 mesh wire without chemicals and complete dispersion). The retention of this fines fraction was determined at the different chemical additions. Different combinations of chemicals were analysed. The cationic starch employed was potato-based and had a degree of substitution of 0.04.

Three different anionic components were tested.

A. A 15% silicic acid sol having a surface area of 500 $m^2/g$ and a ratio $SiO_2$:$Na_2O$ of about 40.

B. A 15% Al-modified silicic acid sol having a surface area of 500 $m^2/g$ and a ratio $SiO_2$:$Na_2O$ of about 40 and 9% Al atoms on the sol surface, which gives 0.46% $Al_2O_3$ on the total solids substance of the sol.

C. The same as B, but 25% Al atoms on the sol surface, which gives 1.2% $Al_2O_3$ on the total solids substance of the sol.

Figure 2:
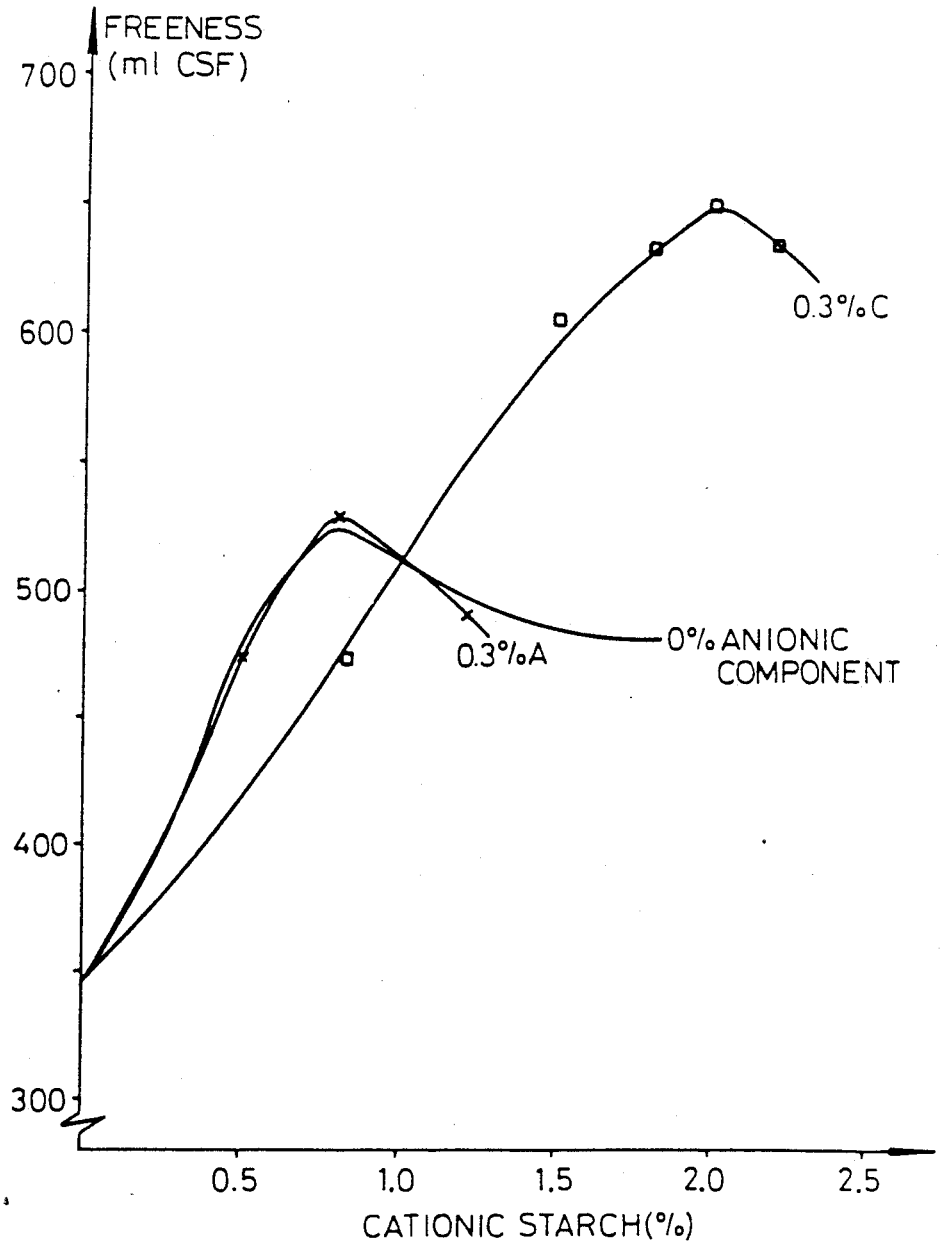

FIGS. 1 and 2 illustrate the results of the analysis in the form of diagrams. The dosed amount of cationic starch refers to the amount added, based upon dry stock. The dosage order was: first cationic starch and then anionic component. It appears from the Figures that the effectiveness of the anionic component increases materially with the Al content in the sol.

EXAMPLE 2

A 0.5% stock consisting of unbleached chemical pulp (pine sulfate with a kappa number of about 53 according to SCAN-Cl) was prepared in the same manner as in Example 1 and beaten to 23° SR, the pH being adjusted to 4.5. 10% C clay (English China Clay) was added to the stock.

The fines retention for different chemical dosages was determined in the same manner as in Example 1.

In this Example, also laboratory sheets were produced by means of a Finnish wire mould (SCAN-C2676). Also in this case, the cationic starch was a potato-based starch having a degree of substitution of 0.04. Two different anionic components were used for this analysis:

A. A 15% silicic acid sol having a surface area of 500 $m^2/g$ and a ratio $SiO_2$:$Na_2O$ of about 40.

B. A 15% Al-modified silicic acid sol having a surface area of 500 $m^2/g$ and a ratio $SiO_2$:$Na_2O$ of about 40. The aluminium content, based on the total amount of surface groups, was 9%, which corresponds to 0.46% on the total solids substance of the sol.

Figure 3:
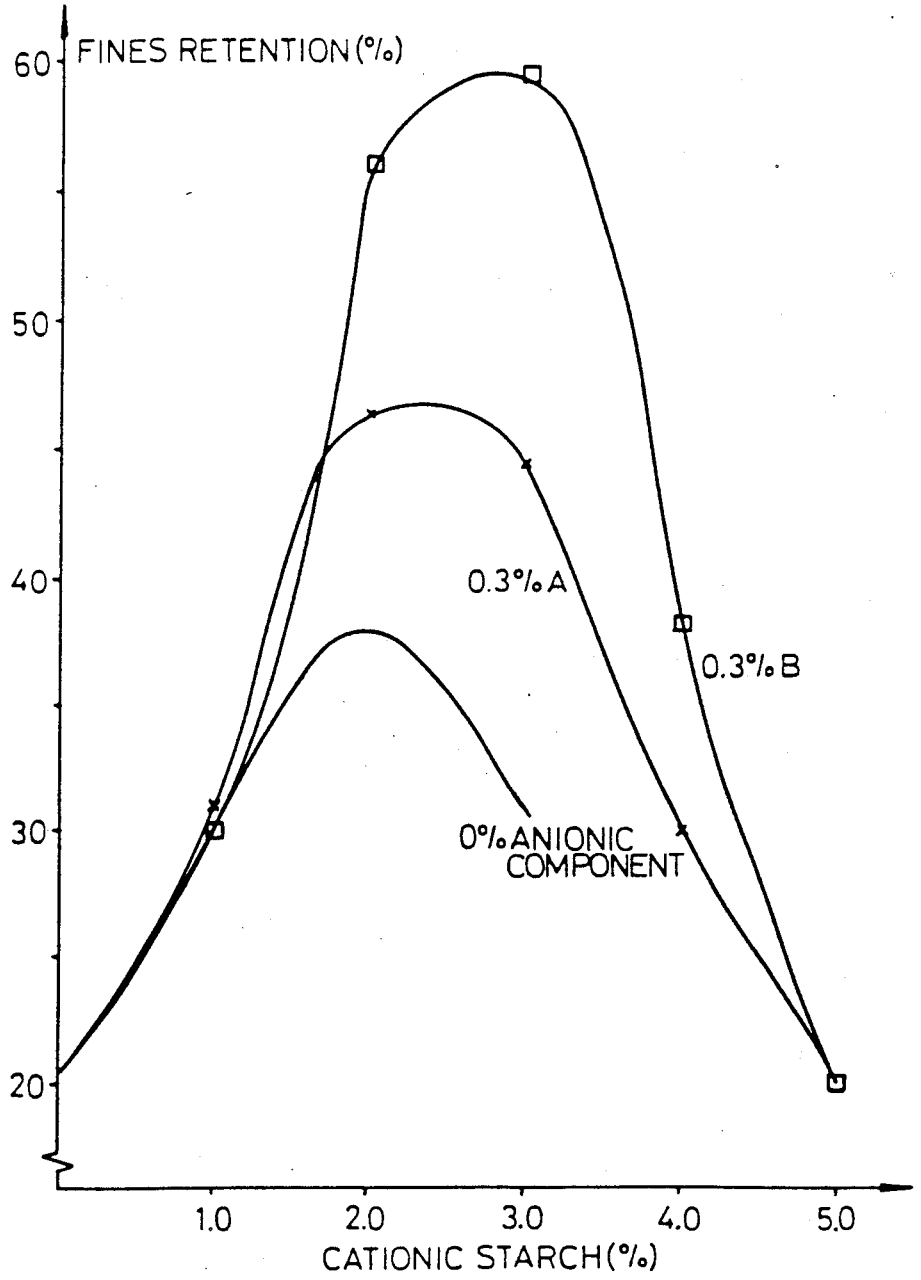

The dosage order was the same as in Example 1. The analysis results are shown in Tables 1 and 2 and in FIG. 3 which is a graphic presentation of the results.

EXAMPLE 3

In this experiment, the fines fraction retention was determined on a stock according to the procedure stated in Example 1. In this instance, the chemicals were a cationic guar gum (GENDRIV® 162 from Henkel Company, USA) with a degree of substitution of 0.18. For this experiment, the stock pH was adjusted to about 4.5. The anionic components were:

A. A 15% silicic acid sol having a surface area of 500 $m^2/g$ and a ratio $SiO_2$:$Na_2O$ of about 40.

B. A 15% Al-modified silicic acid sol having a surface area of 500 $m^2/g$ and a ratio $SiO_2$:$Na_2O$ of about 40. The sol contained 25% Al atoms, based upon the total number of surface groups (Si+Al), which corresponds to 1.2% $Al_2O_3$ on the total solids substance of the sol.

C. This product was a pure aluminium silicate sol obtained by precipitation of water glass with sodium aluminate. Colloids in the order of 200 Å (about 200 $m^2/g$ surface area) could be produced on a laboratory scale. The chemical composition was 88.0% $SiO_2$, 7.5% $Al_2O_3$ and 4.4% $Na_2O$. The dry solids content of the product was 15.9%.

The result of the analysis is shown in Table 3 from which it appears that also in this instance a markedly higher effectiveness is obtained when the Al content in the anionic component is increased.

TABLE 1

| % cationic starch | % A | % B | Fines retention % |
|---|---|---|---|
| 0 | 0 | 0 | 20.5 |
| 1.0 | 0 | 0 | 30.0 |
| 2.0 | 0 | 0 | 38.0 |
| 3.0 | 0 | 0 | 30.5 |
| 1.0 | 0.3 | 0 | 31.0 |
| 2.0 | 0.3 | 0 | 46.5 |
| 3.0 | 0.3 | 0 | 44.5 |
| 4.0 | 0.3 | 0 | 30.0 |
| 5.0 | 0.3 | 0 | 20.0 |
| 1.0 | 0 | 0.3 | 30.0 |
| 2.0 | 0 | 0.3 | 56.0 |
| 3.0 | 0 | 0.3 | 59.5 |
| 4.0 | 0 | 0.3 | 38.0 |
| 5.0 | 0 | 0.3 | 20.0 |

TABLE 2

| | Sheet test results | | |
|---|---|---|---|
| | Chemicals | | |
| Paper characteristics | No chemicals | 1% cationic starch | 1% cationic starch + 0.3% B |
| Grammage ($g/m^2$) | 106 | 115 | 111 |
| Filler content (%) | 10.5 | 11.6 | 10.6 |
| Tensile index (Nm/g) | 58 | 58 | 68 |
| Burst index ($N/m^2$) | 54 | 56 | 58 |
| Picking resistance (Dennison) | 11 | 11 | 14 |
| Elasticity modulus | 2.6 | 2.7 | 3.0 |

TABLE 3

| % cationic guar gum | % A | % B | % C | Fines retention % |
|---|---|---|---|---|
| 0 | 0 | 0 | 0 | 13 |
| 0.2 | 0 | 0 | 0 | 37 |
| 0.4 | 0 | 0 | 0 | 47 |
| 0.2 | 0.3 | 0 | 0 | 46 |
| 0.4 | 0.3 | 0 | 0 | 52 |
| 0.2 | 0 | 0.3 | 0 | 48 |
| 0.4 | 0 | 0.3 | 0 | 58 |
| 0.2 | 0 | 0 | 0.3 | 61 |
| 0.4 | 0 | 0 | 0.3 | 63 |

EXAMPLE 4

A stock was prepared having the following composition: 19.7 g/l TMP (thermomechanical pulp) beaten to 70 ml CSF. The fiber suspension was diluted to 3 g/l with a water from a magazine papermaking machine. The pH of the stock was adjusted to 5.8–6.0 with sulphuric acid.

At different chemical dosages, the dewatering characteristics of the stock were determined, and the present invention was compared with a commercially available dewatering agent of acknowledged effectiveness, viz. the ORGANOPOL-ORGANSORB® system. This system of chemicals consists of bentonite clay and an anionic high-molecular polyacrylamide. These chemicals were dosed at a level which is conventional in the use of the chemicals on the papermaking machine. This system was compared with a system according to the invention, consisting of cationic guar gum having a degree of substitution of 0.28 (MEYPROID® 9801, Mayhall, USA) and a 15% aluminium-modified silicic acid sol with a surface area of 500 $m^2/g$ and a ratio $SiO_2$:$Na_2O$ of about 40 and 9% Al atoms on the sol surface (of total Si+Al), which gives 0.46% $Al_2O_3$ on the total solids substance of the sol.

The result of the analysis is shown in Table 4. The chemical dosages were based upon the amount added per ton of dry pulp. It appears from the results that the chemical system according to the invention has a considerable positive effect on the dewatering characteristics of the stock.

TABLE 4

| Chemical | CSF (ml) |
|---|---|
| No chemicals | 70 |
| 5% ORGANOSORB ® + 0.05% ORGANOPOL ® | 135 |
| 0.4% Guar gum | 80 |
| 0.4% Guar gum + 0.3% Al-modified silicic acid sol | 215 |

EXAMPLE 5

This Example is intended to show that an Al-modified silicic acid sol has a higher reactivity (especially at low pH) to cationic starch than an unmodified silicic acid sol. The reactivity may be regarded as a measure of the effect obtained in a stock and in a finished paper.

The test was carried out as follows:

Cationic starch having a degree of substitution of 0.028 was dissolved in boiling water so that a 0.5% solution was obtained. To 100 g of the solution, an anionic component was added. The anionic components employed were as follows:

A. A 15% silicic acid sol having a surface area of 500 $m^2/g$ and a ratio $SiO_2$:$Na_2O$ of about 40.

B. A 15% aluminium-modified silicic acid sol having a surface area of 500 $m^2/g$ and a ratio $SiO_2$:$Na_2O$ of about 40 and 5% aluminium, based upon the total number of surface groups (Si+Al), which corresponds to 0.25% $Al_2O_3$ on total solids substance of the sol.

After the anionic component had been added, the solution was carefully mixed with a high-speed mixer (Turbo-Mix). The solution was transferred to a centrifugal tube, and the solid phase (anionic component/starch complex) was separated (rpm 3500, 10 min). After centrifugation, 1 ml of the supernatant phase was pipetted. The sample was analysed in respect of dissolved starch (=unreacted starch). In this manner, the proportion of reacted starch, based upon the total amount of starch supplied, could be determined. This is also a measure of the reactivity of the anionic component with respect to the cationic starch.

The result of the test is shown in Table 5. The contents of A and B refer to the percentage by weight of the anionic component in the sample.

TABLE 5

| Component | % reacted starch (of total starch) pH | | |
|---|---|---|---|
| % | 4.5 | 5.5 | 7.0 |
| A: 0.15% | 5 | 8 | 10 |
| A: 0.40% | 20 | 20 | 70 |
| B: 0.15% | 36 | 45 | 80 |
| B: 0.40% | 90 | 86 | 86 |

The test results show that an aluminium-modified silicic acid sol has a far higher reactivity to cationic starch than an unmodified silicic acid sol. This is especially pronounced at low pH.

EXAMPLE 6

This Example relates to the production of folding boxboard on a large papermaking machine with Inver mould units. This board grade comprises 5 layers of which the first layer consists of 90% fully bleached sulfate pulp and 10% filler (talc), the second to fourth layers consist of 80% integrated groundwood pulp and 20% broke, and the fifth layer consists exclusively of semi-bleached sulfate pulp.

In a test run, three different types of chemical systems were compared:

1. POLYMIN® SK, a commercial dewatering agent supplied by BASF AG, Federal Republic of Germany.
2. Cationic potato starch having a degree of substitution of 0.04 and a colloidal silicic acid having a specific area of 500 $m^2/g$.
3. Cationic potato starch having a substitution degree of 0.04 and a colloidal aluminium-modified silicic acid having a surface area of 500 $m^2/g$ and an Al:Si ratio of 1:12 (surface groups).

The dosage of the chemicals was as follows: 200 g/ton POLYMIN® SK after the pressure screens of the three central layers (case 1). In case 2, 6 kg of cationic starch/ton were added to the machine chest and 1.5 kg of colloidal silicic acid/ton after the pressure screens. In case 1, the chemicals were dosed in the same position as in case 2. Since the different chemical systems gave different dewatering effects on the machine, the speed, and thus the product, was adjusted such that the steam consumption was maintained at maximum level, i.e. the production level is a measure of the effectiveness of the different chemical systems.

Figure 4:
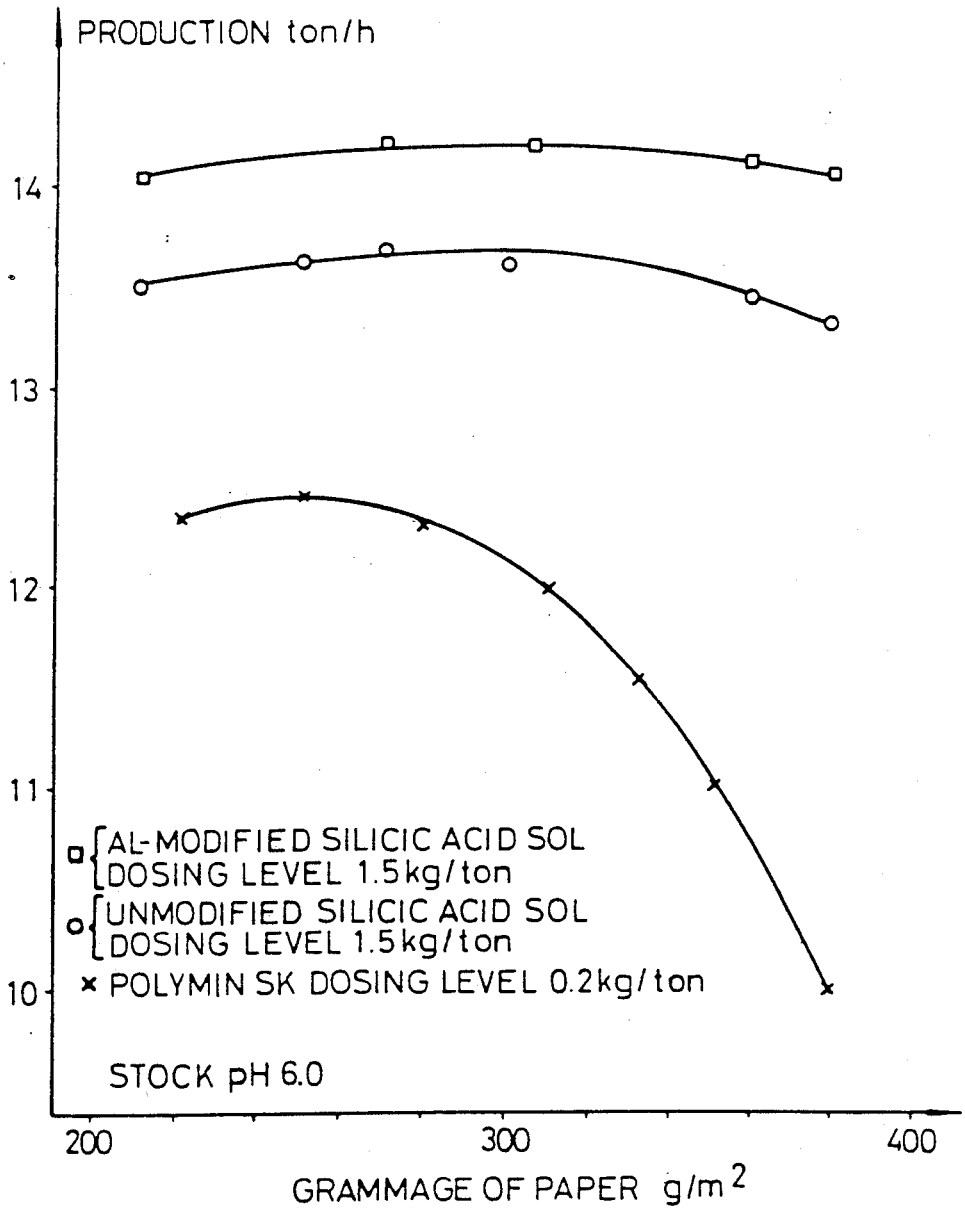

The result of the analysis is shown in the form of a diagram in FIG. 4. The diagram clearly shows that the aluminium-modified silicic acid sol has a higher effect than the unmodified silicic acid sol and a far better effect than the commercial product, especially at high grammage values of the board.

EXAMPLE 7

In this Example, use was made of a carbohydrate in the form of amylopectin purchased from Laing National Ltd., Great Britain, and having a degree of cationisation of about 0.035 and a nitrogen content of about 0.31%. This carbohydrate was used together with Al-modified silicic acid sol having a surface area of about 500 $m^2/g$ and a ratio $SiO_2:Na_2/O$ of about 40:1, and 9% aluminium, based upon the total number of surface groups. The stock was a magazine paper stock consisting of 76% fibers and 24% filler (C clay from English China Clay). The fiber portion of the stock was composed of 22% chemical pine sulfate pulp, 15% thermomechanical pulp, 35% groundwood pulp, and 28% broke from the same papermaking machine. The stock had been taken from the magazine papermaking machine and was diluted with white water from the same machine to a concentration of 3 g/l, which is suitable for dewatering tests. The pH of the stock was adjusted with NaOH aqueous solution to 5.5. The drainability of the stock (measured as Canadian Standard Freeness) was determined at different dosings of amylopectin alone or together with Al-modified silicic acid sol. The chemicals were dosed to 1 liter of stock having a concentration of 3 g/l under agitation at rpm 800. The amylopectin was added first under agitation, followed by agitation for 30 s. Then the sol was added under agitation, followed by agitation for a further 15 s. Finally, draining was carried out. When no sol was added to the stock, agitation for 45 s was carried out instead, following the addition of the amylopectin, whereupon draining was carried out.

Figure 5:
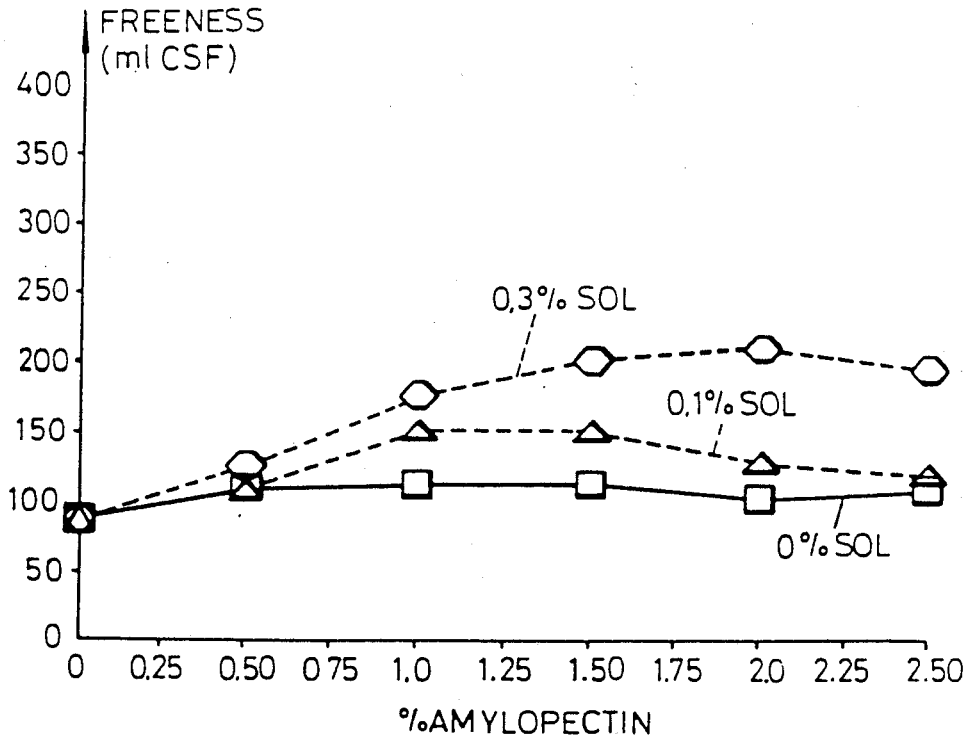

In appears from Table 6 and FIG. 5 that amylopectin alone gives an insignificant dewatering effect, and that the combination of Al-modified silicic acid sol and amylopectin gives a considerable increase in drainability. At best, the CSF value is doubled at 2% amylopectin and 0.3% sol.

TABLE 6

| Run | Amylopectin (%) | Al-mod. sol (%) | CSF (ml) |
|---|---|---|---|
| 1 | — | — | 90 |
| 2 | 0.5 | — | 110 |
| 3 | 1.0 | — | 115 |
| 4 | 1.5 | — | 115 |
| 5 | 2.0 | — | 105 |
| 6 | 2.5 | — | 110 |
| 7 | 0.5 | 0.1 | 110 |
| 8 | 1.0 | 0.1 | 150 |
| 9 | 1.5 | 0.1 | 150 |
| 10 | 2.0 | 0.1 | 130 |
| 11 | 2.5 | 0.1 | 120 |
| 12 | 0.5 | 0.3 | 125 |
| 13 | 1.0 | 0.3 | 175 |
| 14 | 1.5 | 0.3 | 200 |
| 15 | 2.0 | 0.3 | 210 |
| 16 | 2.5 | 0.3 | 195 |

We claim:

1. A paper making process comprising forming and drying of an aqueous paper pulp containing cellulosic fibers wherein anionic and cationic components are separately added to the aqueous paper pulp prior to forming the paper, said anionic component being added as a sol comprising colloidal anionic particles having a size less than 20 nm and having at least a surface layer of aluminum silicate or aluminum-modified silicic acid containing silicon and aluminum atoms in a ratio of about 9.5:0.5 to 7.5:2.5, and said cationic component comprising at least one cationic or amphoteric carbohydrate comprising a starch, amylopectin or guar gum, wherein the cationic component is cationized to a degree of substitution of 0.01 to 1.0 and further wherein the components are added in amounts such that the solids of the components are present in an amount of at least 0.1% by weight of the cellulosic fiber.

2. A paper making process according to claim 1 wherein the colloidal anionic particles comprise aluminum-modified silicic acid.

3. A process according to claim 1 or 2 wherein the cationic component comprises cationic starch or cationic amylopectin.

4. A process according to claim 1 or 2 wherein the cationic component comprises guar gum.

5. A process according to claim 1 or 2 wherein the weight ratio of anionic component to cationic component is between 0.1:1 and 25:1.

6. A process according to claim 1 or 2 wherein the sol particles of the anionic sol have a surface area of about 300 to about 700 $m^2/g$.

7. A process according to claim 1 or 2 wherein the pH of the pulp is adjusted so as to be from about 4 to about 10.

8. A process according to claim 7 wherein the pH of the pulp is adjusted so as to be from about 4 to about 7.

9. A process according to claim 1 or 2 wherein the aqueous paper pulp contains a mineral filler and the anionic and cationic components are added in amounts such that the solids of the components are present in an amount of about 0.5 to 25% by weight of the filler.

10. A process according to claim 1 wherein the cationic component is added to the aqueous pulp prior to the anionic component.

11. A paper product comprising cellulosic fibers which are present in an amount of at least 50% by weight of the paper product, an anionic component and a cationic component wherein the anionic component comprises colloidal anionic particles having a size less than 20 nm and having at least a surface layer of aluminum silicate or aluminum-modified silicic acid containing silicon and aluminum atoms in a ratio of 9.5:0.5 to 7.5:2.5, and the cationic component comprises at least one cationic or amphoteric carbohydrate comprising a starch, amylopectin, or guar gum, and has a degree of substitution of at least 0.01 and at most 1.0 and further wherein the solids of the components are present in an amount of at least 0.1% by weight of cellulosic fibers.

12. A product according to claim 11 wherein the anionic particles comprise aluminum-modified silicic acid.

13. A product according to claim 11 or 12 wherein the weight ratio of the anionic component to the cationic component is between 0.1:1 and 25:1.

* * * * *

UNITED STATES PATENT AND TRADEMARK OFFICE

CERTIFICATE OF CORRECTION

PATENT NO. : 4,961,825

DATED : October 9, 1990

INVENTOR(S) : KJELL RUNE ANDERSSON et al

It is certified that error appears in the above-identified patent and that said Letters Patent is hereby corrected as shown below:

Claim 5, line 2, "anionic" should read --cationic-- and "cationic" should read --anionic--.

Claim 13, lines 2 and 3, "anionic" should read --cationic-- and "cationic" should read --anionic--.

Signed and Sealed this

Ninth Day of June, 1992

*Attest:*

DOUGLAS B. COMER

*Attesting Officer*

*Acting Commissioner of Patents and Trademarks*